US006608434B2

(12) United States Patent
Etou et al.

(10) Patent No.: US 6,608,434 B2
(45) Date of Patent: Aug. 19, 2003

(54) COLOR PICTURE TUBE

(75) Inventors: Hideaki Etou, Osaka (JP); Atsushi Kato, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/090,092

(22) Filed: Mar. 4, 2002

(65) Prior Publication Data

US 2002/0125811 A1 Sep. 12, 2002

(30) Foreign Application Priority Data

Mar. 6, 2001 (JP) ..... 2001-061320

(51) Int. Cl.[7] ..... H01J 29/80; H01J 29/10
(52) U.S. Cl. ..... 313/408; 313/461; 313/470
(58) Field of Search ..... 313/408, 461, 313/467, 469, 468, 470–472, 462–466, 402–407

(56) References Cited

U.S. PATENT DOCUMENTS 3,844,005 A * 10/1974 Yamada et al. ..... 445/47
3,900,757 A * 8/1975 Kaplan ..... 313/402
4,296,189 A * 10/1981 Kuzminski ..... 430/5
5,896,001 A * 4/1999 Shishido ..... 313/461

FOREIGN PATENT DOCUMENTS

EP 0 487 106 5/1992
JP 58128636 A * 8/1983 ..... H01J/29/07
JP 5-6741 1/1993

* cited by examiner

*Primary Examiner*—Vip Patel
*Assistant Examiner*—German Colón
(74) *Attorney, Agent, or Firm*—Merchant & Gould, P.C.

(57) ABSTRACT

In a color picture tube, a phosphor screen is formed on an inner face of a face panel, which is formed of a plurality of phosphor lines in the form of stripes, and a color selecting electrode opposed to the phosphor screen is provided. The color selecting electrode has a plurality of apertures and bridges each separating the adjacent apertures from each other in a direction along the phosphor lines. In the vicinities of shadows of the bridges formed as a result of projection by electron beams, each of light emitting regions in which the phosphor lines emit light by irradiation with the electron beams has a part in which a wide portion of a greater width than a basic width Wb of the light emitting region is provided. Darkening of the phosphor screen can be compensated, which is caused by the shadows of the bridges shading the phosphor lines. Thus, a decrease in the luminance of the phosphor screen and picture noise that are caused by the shadows of the bridges can be suppressed.

6 Claims, 8 Drawing Sheets

COLOR PICTURE TUBE

BACKGROUND OF THE INVENTION

1. Field of the Invention

The present invention relates to a color picture tube, for example used as a television receiver or a computer monitor.

2. Related Background Art

FIG. 2 is a schematic sectional view of a color picture tube in common use.

In FIG. 2, a color picture tube 1 has an envelope composed of a face panel 3 having an inner face on which a phosphor screen 2 is formed and a funnel 4 bonded to the rear part of the face panel 3, which includes a color selecting electrode 5 opposed to the phosphor screen 2, a frame 6 supporting the color selecting electrode 5, and an electron gun 8 provided in a neck portion 7 of the funnel 4. Three electron beams 9 (the electron beams overlap one another so as to be seen as one electron beam in the figure) are emitted from the electron gun 8. The electron beams 9 pass through a plurality of apertures provided on the color selecting electrode 5 while being deflected by a deflection yoke 10 provided at an outer portion of the funnel 4 to land on the phosphor screen 2.

FIG. 8 schematically shows a state of a color selecting electrode and a phosphor screen of a conventional color picture tube. On a color selecting electrode 5, a plurality of apertures 11 of substantially slot shape are formed. On a phosphor screen 2, blue-, green-, and red-emitting phosphor lines 12*b*, 12*g*, and 12*r* of substantially a given width are arranged in the form of stripes. When the color picture tube is in operation, three electron beams pass through the apertures 11 to land at the phosphor screen, so that the phosphor lines 12*b*, 12*g*, and 12*r* are irradiated with beams 13*b*, 13*g*, and 13*r* that have passed through the apertures 11. Then, irradiated portions 14 of the phosphor lines 12*b*, 12*g*, and 12*r* emit light, and thus an image is formed.

However, the conventional color picture tube with the phosphor screen described above has presented a problem of a limit to improvements in luminance.

When electron beams pass through the apertures of the color selecting electrode to be irradiated onto the phosphor lines, bridges 15, each provided between the adjacent apertures 11 in a vertical direction (a direction along the phosphor lines), form shadows on the phosphor lines 12*b*, 12*g*, and 12*r* to produce non-light emitting portions 16. The larger the number of the bridges 15, the larger the number of the non-light emitting portions 16, and thus the more the luminance across the phosphor screen decreases. The luminance can be improved simply by setting a pitch Pv in the vertical direction of the apertures 11 to be large so that the bridges 15 are reduced in number. However, this causes the shadows of the bridges projected on the phosphor screen to be perceived by the human eye, and thus the non-light emitting portions 16 are likely to be perceived visually as black stripes, i.e. picture noise.

That is, in the conventional technique, while the luminance across the phosphor screen is low due to the shadows of the bridges, there is a limit to improvements in luminance from the standpoint of picture quality, which has been disadvantageous.

Therefore, with the foregoing in mind, it is an object of the present invention to provide a color picture tube that can achieve excellent picture quality and high luminance.

SUMMARY OF THE INVENTION

In order to solve the aforementioned problem, a color picture tube of the present invention includes an envelope composed of a face panel having an inner face on which a phosphor screen is formed and a funnel bonded to the rear part of the face panel, the phosphor screen being formed of a plurality of phosphor lines in the form of stripes, in which a color selecting electrode opposed to the phosphor screen is provided. The color selecting electrode has a plurality of apertures and bridges that separate the adjacent apertures from each other in a direction along the phosphor lines. Electron beams emitted from an electron gun in the funnel hit the color selecting electrode and pass through the apertures to land at the phosphor screen. In the color picture tube described above, in the vicinities of shadows of the bridges formed as a result of projection by the electron beams, each of light emitting regions in which the phosphor lines emit light by irradiation with the electron beams has a part in which a wide portion of a greater width than a basic width of the light emitting region is provided.

In the present invention, "the basic width of the light emitting region" is defined as a width of the light emitting region in a portion other than both end portions in a longitudinal direction. When the portion of the light emitting region other than both the end portions can be deemed to be substantially even in width, "the basic width of the light emitting region" refers to the width of the light emitting region in the portion other than both the end portions. When the portion of the light emitting region other than both the end portions is uneven in width (without consideration of an unintended fault caused in the manufacturing process), "the basic width of the light emitting region" refers to a width of the light emitting region in a portion having the smallest width or a width of the light emitting region in the midsection in the longitudinal direction.

According to this configuration, when the color picture tube is in operation, darkening of the phosphor screen can be compensated, which is caused by the shadows of the bridges shading the phosphor lines. Thus, a color picture tube can be provided that can prevent a decrease in the luminance of a phosphor screen and picture noise that are caused by shadows of bridges, and can achieve excellent picture quality and high luminance.

In the color picture tube of the present invention, preferably, in the vicinities of the shadows, each of the phosphor lines has parts in which a wide portion of a greater width than a basic width of the phosphor lines is provided.

According to this configuration, the light emitting regions, each having the part in which the wide portion is provided, can be obtained easily.

Furthermore, in the color picture tube of the present invention, preferably, an area S1 of an auxiliary light emitting region, which is obtained by subtracting an area of a basic width light emitting region having a width corresponding to the basic width from an area of the wide portion of the light emitting region, and an area S2, which is a basic width non-light emitting region having a width corresponding to the basic width as a part of a non-light emitting portion shaded with the shadow of the bridge, satisfy the relationship: $0.9 \leqq S1/S2 \leqq 1.1$. The area S1 of the auxiliary light emitting region is defined, for example, when with respect to each shadow of the bridges, the wide portion is formed on both sides in a vertical direction, as a total area of the auxiliary light emitting regions in both of the wide portions.

Moreover, in the color picture tube of the present invention, preferably, a length Lw of the wide portion in the vertical direction and a pitch Pv of the apertures in the vertical direction satisfy the relationship: $0<Lw/Pv\leqq 0.1$. The length Lw of the wide portion in the vertical direction is defined, for example when with respect to each shadow of the bridges, the wide portion is formed on both sides in the vertical direction, as a distance between an upper end of the wide portion on the upper side and a lower end of the wide portion on the lower side.

According to this configuration, a difference in luminance can be suppressed, which is likely to be caused considerably in the vicinities of the shadows of the bridges.

Furthermore, in the color picture tube of the present invention, preferably, each of the apertures of the color selecting electrode has a protrusion protruding in a horizontal direction at least at one end portion in the vertical direction.

According to this configuration, the phosphor lines, each having the parts in which the wide portion is provided, can be formed easily. Alternatively, the light emitting regions each having the wide portion in the vicinities of the shadows of the bridges can be formed easily.

Moreover, in the color picture tube of the present invention, preferably, a maximum width W1 of the apertures in the horizontal direction in the protrusion and a width W2 of the apertures in the horizontal direction in the midsection satisfy the relationship: $1.0<W1/W2\leqq 1.5$.

According to this configuration, a color shift caused when the color picture tube is in operation can be suppressed.

DETAILED DESCRIPTION OF THE INVENTION

Figure 2:
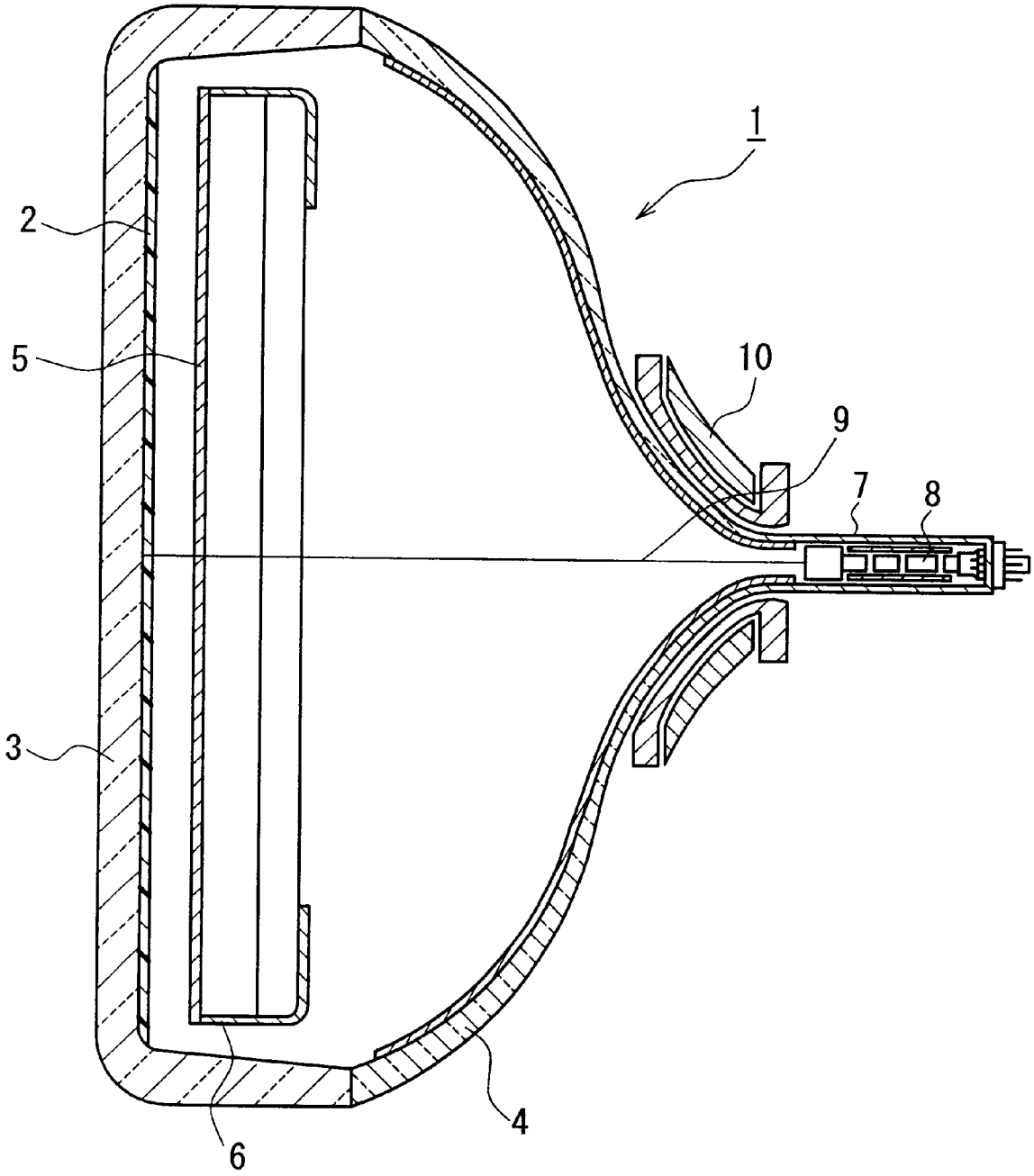
FIG. 2 PRIOR ART
FIG. 2 is a schematic sectional view of a color picture tube in common use.

Hereinafter, the present invention will be described by way of embodiments with reference to the appended drawings. In embodiments of the present invention, the respective configurations of components are similar to those of like components of the color picture tube described in regard to the conventional technique with reference to FIG. 2, and thus duplicate descriptions of the configurations are omitted.

(Embodiment 1)

Figure 3:
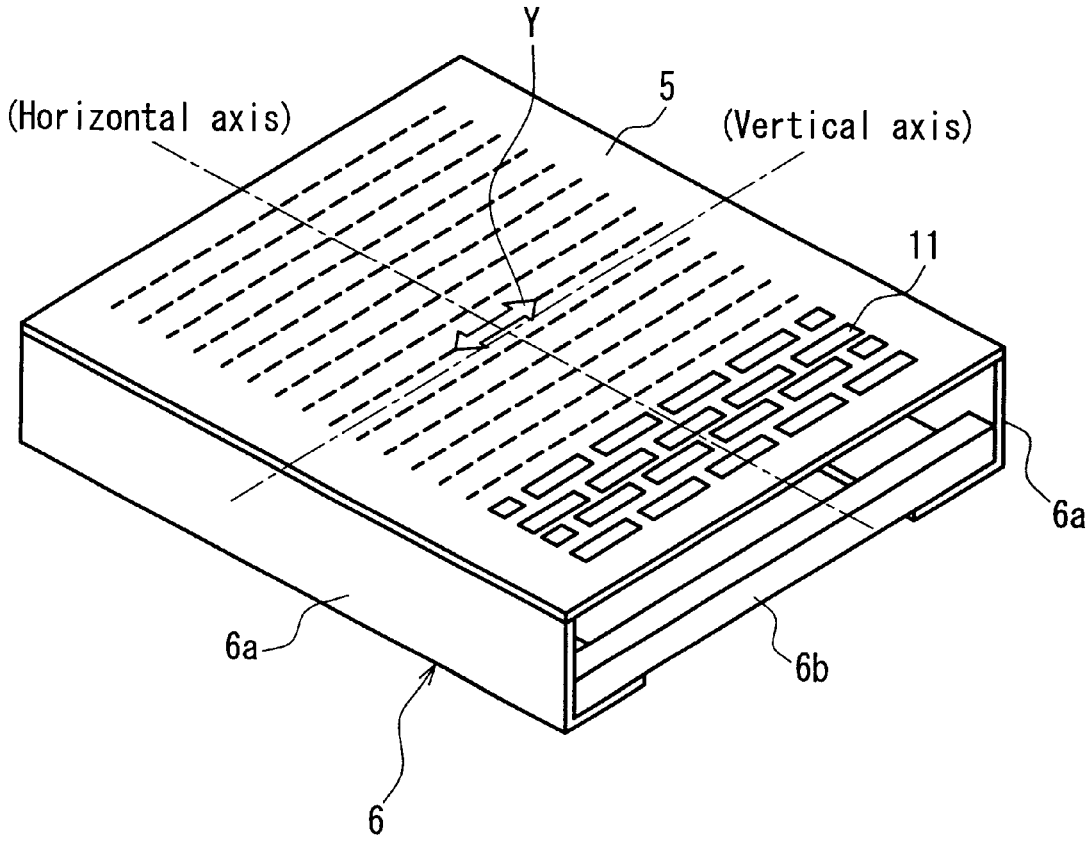
FIG. 3 is an assembly drawing in perspective of the color selecting electrode and a frame of the color picture tube according to Embodiment 1 of the present invention.

FIG. 3 is a perspective view of a color selecting electrode and a frame of a color picture tube according to Embodiment 1 of the present invention. A frame 6 is formed into a rectangular frame body in which a pair of short-side frames 6*b* are fixed so as to extend across a pair of long-side frames 6*a* that are opposed to each other. A color selecting electrode 5 is held by the long-side frames 6*a* under a tension in a direction indicated by arrows Y (called a vertical direction for reference) as shown schematically in FIG. 3. In the color selecting electrode 5, a multiplicity of apertures 11 of substantially slot shape are formed.

Figure 1:
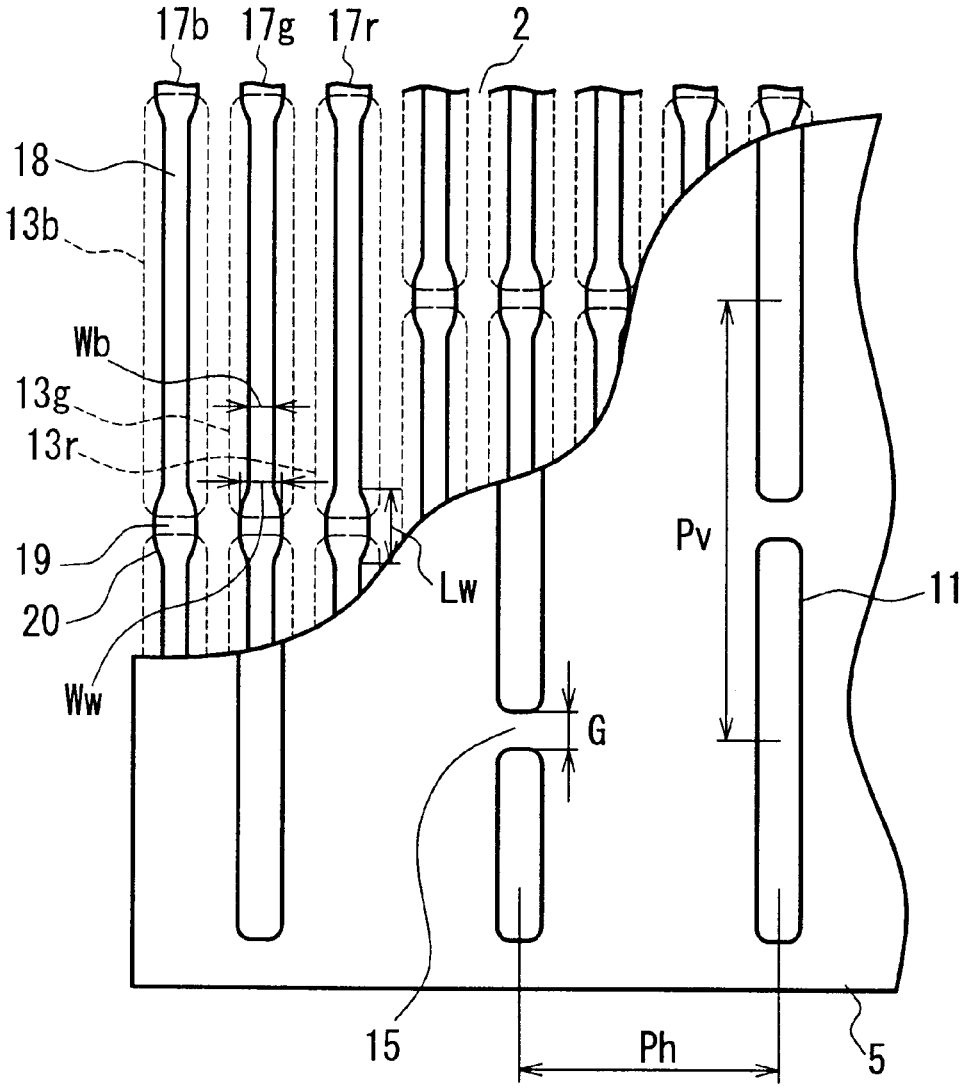
FIG. 1 is a schematic diagram showing a color selecting electrode and a phosphor screen of a color picture tube according to Embodiment 1 of the present invention.

FIG. 1 schematically shows a state of the color selecting electrode and a phosphor screen of the color picture tube according to this embodiment. On a phosphor screen 2, blue-, green-, and red-emitting phosphor lines 17*b*, 17*g*, and 17*r* are arranged in the form of stripes so as to correspond to each string of the apertures 11 of the color selecting electrode 5. When three electron beams pass through the apertures 11 to land at the phosphor screen 2, the phosphor lines 17*b*, 17*g*, and 17*r* of colors each corresponding to the respective electron beams are irradiated with beams 13*b*, 13*g*, and 13*r* that have passed through the apertures 11. Then, irradiated portions 18 of the phosphor lines 17*b*, 17*g*, and 17*r* emit light, and thus an image is formed.

Figure 4:
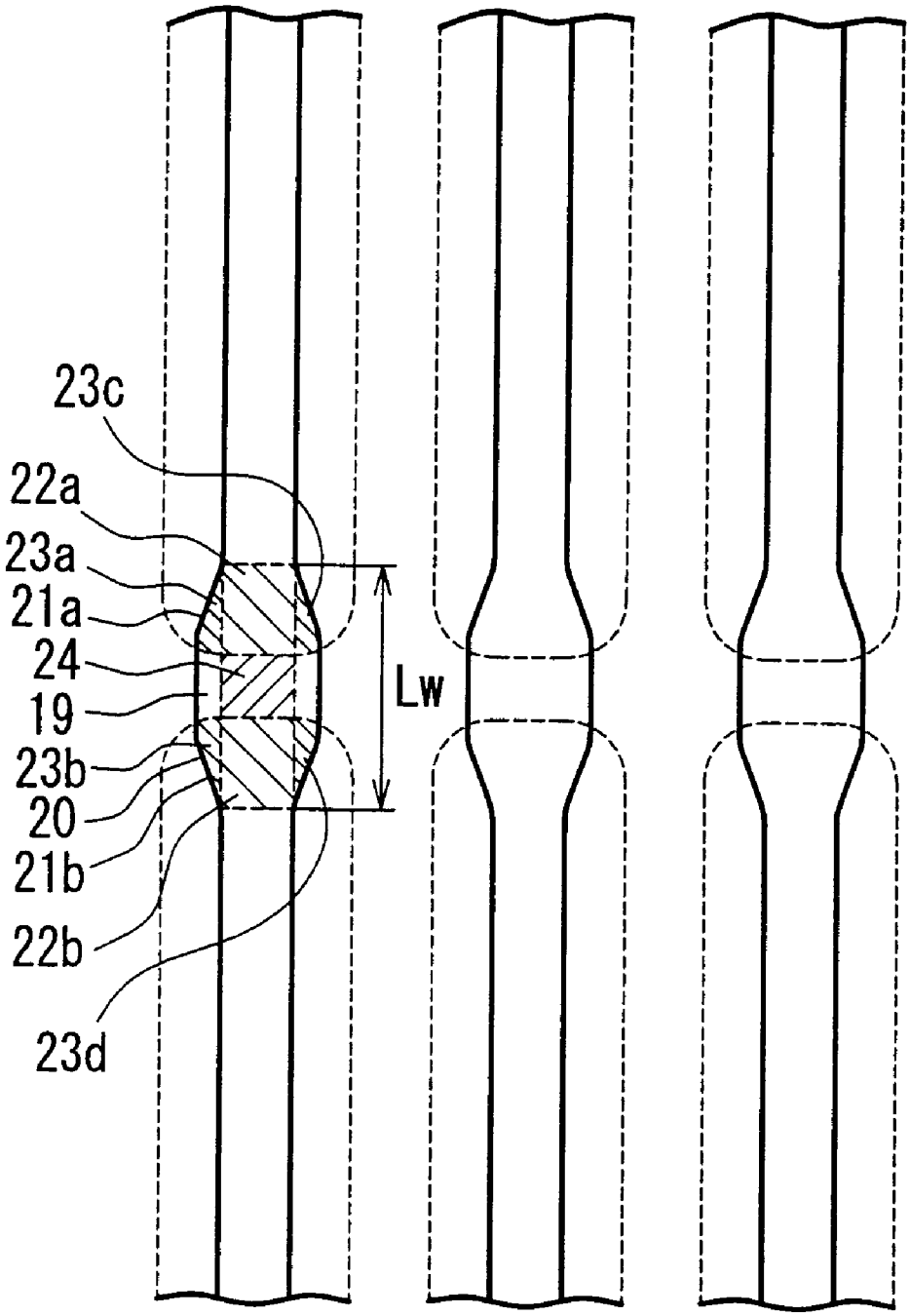
FIG. 4 is a schematic diagram showing the phosphor screen of the color picture tube according to Embodiment 1 of the present invention.

Each of the phosphor lines 17*b*, 17*g*, and 17*r* has wide portions 20 in non-light emitting portions 19 shaded with shadows of bridges 15 of the apertures 11 and in the vicinities of the non-light emitting portions 19. That is, the phosphor lines have a width Ww in the wide portion 20 that is greater than a basic width Wb of the phosphor lines. In each of the wide portions 20, preferably, as shown in FIG. 4, a total area (denoted by S1) of auxiliary light emitting regions 23*a* to 23*d* obtained by subtracting areas of basic width light emitting regions (light emitting regions having a width corresponding to the basic width of the phosphor lines) 22*a* and 22*b* from areas of light emitting regions 21*a* and 21*b* emitting light in the wide portion 20 substantially equals to an area (denoted by S2) of a basic width non-light emitting region 24 having a width corresponding to the basic width as a part of each of non-light emitting portions 19 of the phosphor lines. This configuration is preferable particularly when a pitch Pv in a vertical direction of the apertures 11 is large.

When an area ratio between the total area of the auxiliary light emitting regions and the area of the basic width non-light emitting region, i.e. S1/S2 is too low, luminance decreases in the non-light emitting portions formed by the bridges. On the other hand, when the ratio is too high, luminance increases in the wide portions. Either of the above cases cause picture quality to be degraded. When a pitch in the vertical direction of the apertures is large, that is, the number of the bridges is smaller, particularly when the pitch Pv in the vertical direction is larger by a factor of two or more than a pitch Ph in a horizontal direction, a difference in luminance is likely to be perceived considerably in the vicinities of the bridges. Thus, it is more preferable that the ratio of S1/S2 falls within the range of 0.9 to 1.1.

Furthermore, when each of the wide portions of the phosphor lines is too long in the vertical direction, the shadows of the bridges are likely to be perceived considerably in the wide portions because of the excess in the length of the wide portions. In such a case, even when the area ratio of S1/S2 is set to fall within the range of 0.9 to 1.1, picture quality can not be improved. Thus, preferably, the wide portions have a length Lw in the vertical direction that is not more than 10% of the pitch Pv in the vertical direction of the apertures.

In an example of this embodiment, a color picture tube to be used as a computer monitor having a screen diagonal size of 51 cm was employed. In the color picture tube, the pitch Pv in the vertical direction of the apertures, the pitch Ph in the horizontal direction of the apertures, and a width G in the vertical direction of the bridges shown in FIG. 1 were 5.2 mm, 0.23 to 0.25 mm, and 0.02 to 0.04 mm, respectively. Further, in phosphor lines that were employed, the basic width Wb, the width Ww in the wide portion, and the length Lw in the vertical direction of the wide portions were 0.048 to 0.051 mm, 0.055 to 0.058 mm, and 0.3 to 0.5 mm, respectively. Needless to say, these values may vary depending on factors such as the size and intended use of a color picture tube.

In this embodiment described above, the phosphor lines have the parts in which the wide portion having the greater width than the basic width is provided. According to this configuration, darkening can be compensated, which is caused by the shadows of the bridges shading the phosphor lines. Thus, improvements in luminance can be achieved by compensating for a decrease in the luminance of the phosphor screen caused by the shadows of the bridges. Further, picture quality can be improved with reliability by regulating the length and width of the wide portions of the phosphor lines.

Moreover, even when the pitch in the vertical direction of the apertures is large, the non-light emitting portions formed by the shadows of the bridges are not likely to be perceived as picture noise, and thus the bridges can be reduced in number. As a result, a color shift can be prevented, which is attributable to the bridges conducting thermal expansion of the color selecting electrode caused when the color picture tube is in operation.

Thus, according to the present invention, a color picture tube can be realized, which achieves excellent picture quality, high luminance, and high color purity.

In the present invention, "the basic width of the phosphor lines" is defined as a width of the phosphor line in a portion other than the vicinities of the non-light emitting portions 19 formed by the shadows of the bridges 15. When the portion of the phosphor line other than the vicinities of the non-light emitting portions 19 can be deemed to be substantially even in width, "the basic width of the phosphor lines" refers to the width of the phosphor line in the portion other than the vicinities of the non-light emitting portions 19. When the portion of the phosphor line other than the vicinities of the non-light emitting portions 19 is uneven in width (without consideration of an unintended fault caused in the manufacturing process), "the basic width of the phosphor lines" refers to a width of the phosphor line in a portion having the smallest width or a width of the phosphor line in a midsection between two of the adjacent non-light emitting regions 19 in a longitudinal direction.

The phosphor lines having the parts in which the wide portion is provided as described above can be formed by a method in which conditions of a light exposure system for forming a phosphor screen are set as required. The light exposure system includes a light source, a light amount correction filter, or other components. However, the phosphor lines also can be realized by characterizing the shape of apertures of a color selecting electrode. The following description is directed to an embodiment in which the shape of apertures of a color selecting electrode is characterized. (Embodiment 2)

Figure 5:
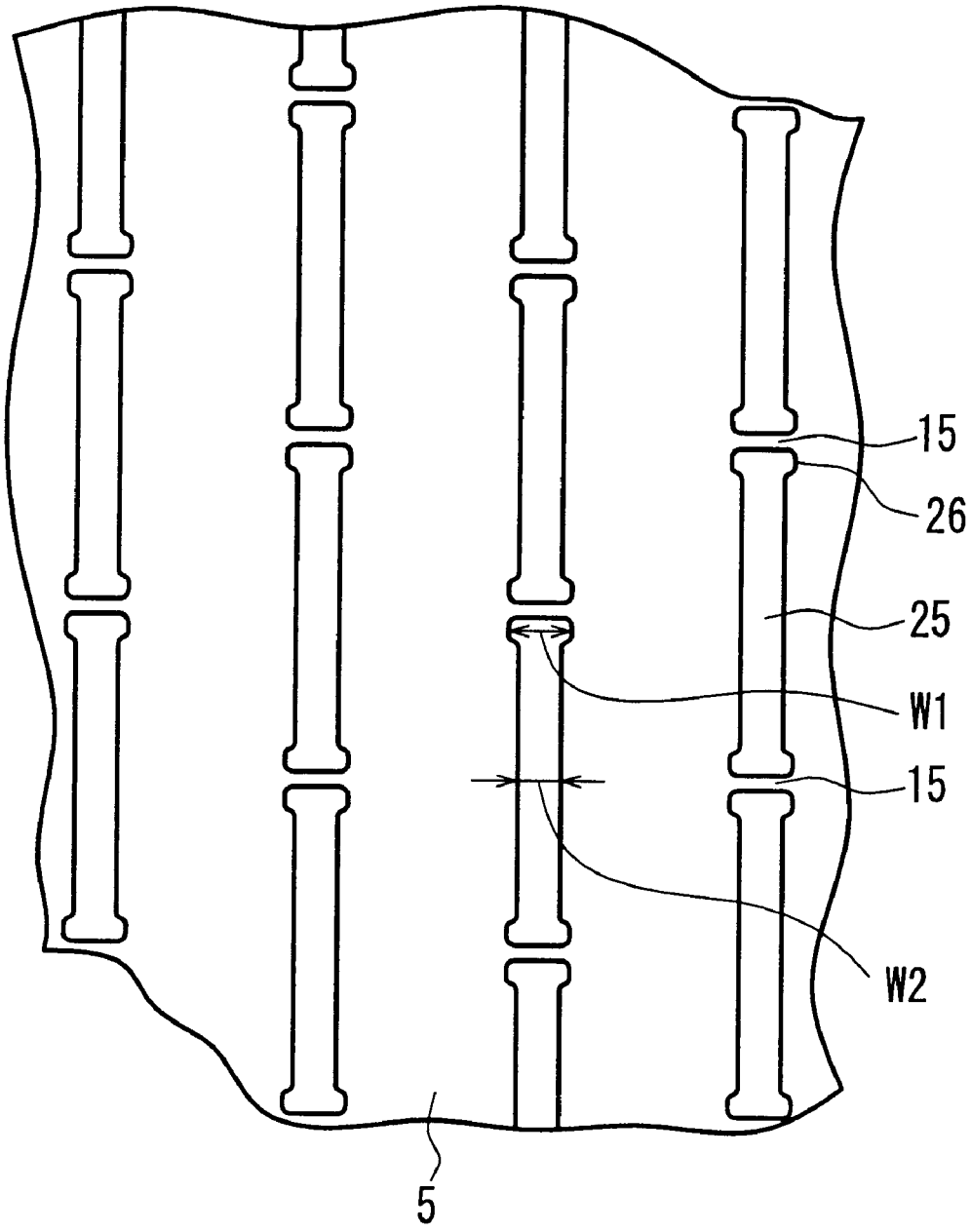
FIG. 5 is a schematic diagram showing a color selecting electrode of a color picture tube according to Embodiment 2 of the present invention.

FIG. 5 schematically shows a color selecting electrode of a color picture tube according to Embodiment 2 of the present invention. In a color selecting electrode 5, a multiplicity of apertures 25 of substantially I-shape are formed. That is, each of the apertures 25 has protrusions 26 protruding in a horizontal direction in the vicinities of bridges 15. The apertures 25 have a maximum width W1 in the protrusion 26 that is greater than a width W2 in the midsection.

Generally, a color selecting electrode has apertures of substantially slot shape. Therefore, in most cases of forming phosphor lines in the form of stripes, the phosphor lines are formed so as to have substantially a given width by allowing this color selecting electrode or a light source to shift up and down in a vertical direction using the color selecting electrode. In this embodiment, the apertures of the color selecting electrode are of substantially I-shape. Accordingly, phosphor lines having parts in which a wide portion is provided can be formed by the same light exposure method as in the conventional case, in which the color selecting electrode shown in FIG. 5 or the light source is allowed to shift up and down using the color selecting electrode. This does not require conditions of a light exposure system to be set in a particular manner.

Preferably, the substantially I-shaped apertures described above have the maximum width W1 in the protrusion that is greater by a factor of 1.5 or less than the width W2 in the midsection. According to this configuration, degradation in color purity can be suppressed, which is caused by three electron beams that have passed through one aperture overlapping one another or each of the three electron beams being irradiated onto a phosphor line of a color not corresponding to the electron beam when the color picture tube is in operation.

Figure 6:
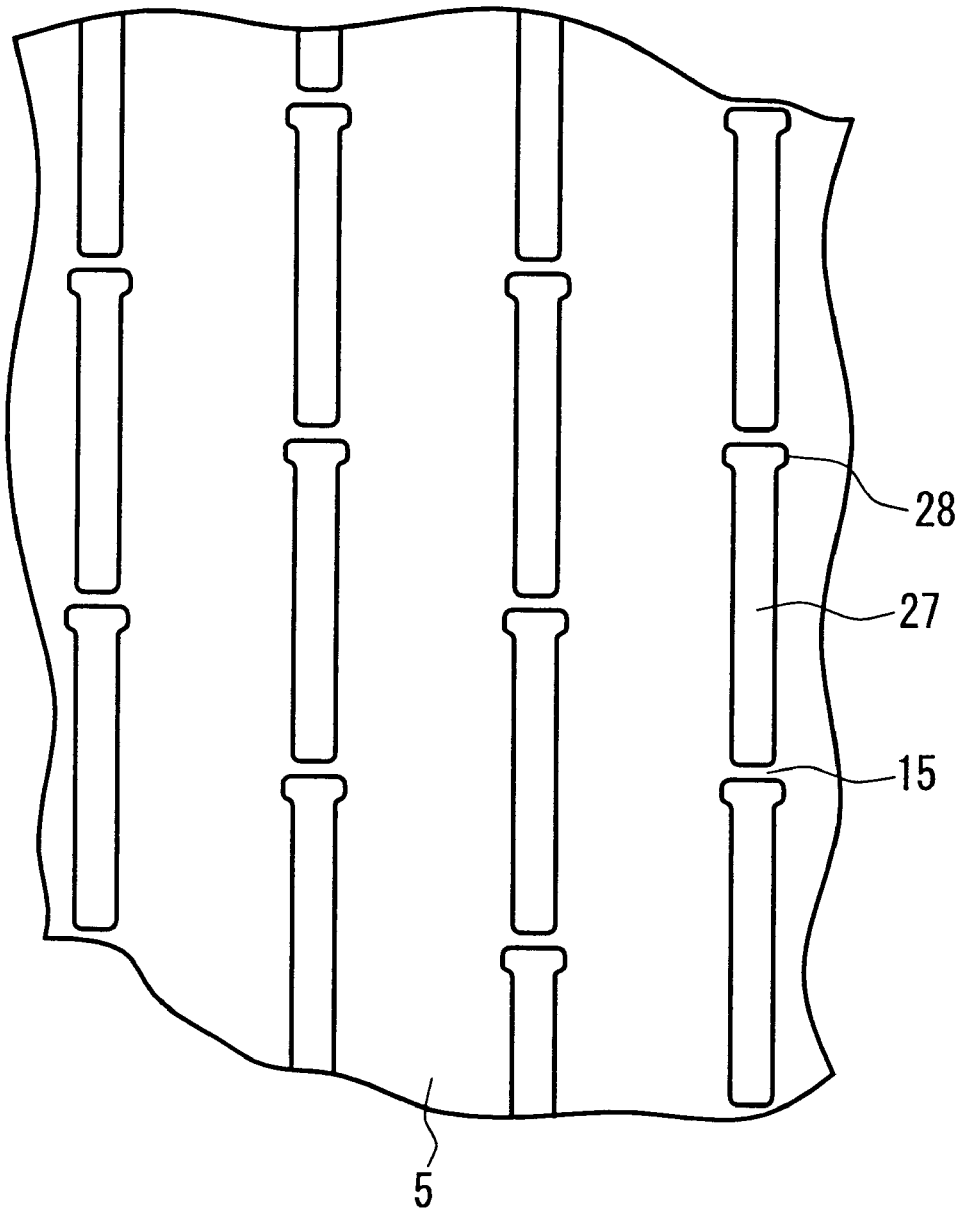
FIG. 6 is a schematic diagram showing another example of a color selecting electrode of the color picture tube according to Embodiment 2 of the present invention.

The foregoing description was directed to the example in which the apertures were of substantially I-shape with protrusions provided at both ends in the vertical direction. However, for example, as shown in FIG. 6, apertures 27 may be of substantially T-shape with a protrusion 28 provided only on one end in a vertical direction. In this case of the substantially T-shaped apertures, phosphor lines that have parts in which a wide portion is provided also can be formed easily by the same light exposure method as in the conventional case, in which a color selecting electrode or a light source is allowed to shift up and down. This configuration also provides the following advantage. Since the protrusion is provided only on the one side in the vertical direction of the apertures, a length in the vertical direction of the wide portions of the phosphor lines can be controlled easily when performing exposures by allowing a color selecting electrode or a light source to shift up and down. In the case of the substantially T-shaped apertures, the apertures in a region above a horizontal axis of the color selecting electrode and the apertures in a region below the horizontal axis of the color selecting electrode may be formed into shapes so as to be substantially symmetrical with respect to each other. That is, the apertures in the region above the horizontal axis of the color selecting electrode may be of substantially T-shape, and the apertures in the region below the horizontal axis of the color selecting electrode may be of substantially inverted T-shape.

As described in Embodiment 1, desirably, the wide portions of the phosphor lines have the length in the vertical direction that is not more than 10% of the pitch Pv in the vertical direction of the apertures. In order to achieve this, preferably, the color selecting electrode described in this embodiment has the following configuration. In the case of the substantially I-shaped apertures, each of the protrusions has a length in the vertical direction that is not more than 5% of the pitch Pv in the vertical direction of the apertures. In the case of the substantially T-shaped apertures, the protrusion has a length in the vertical direction that is not more than 10% of the pitch Pv in the vertical direction of the apertures.

(Embodiment 3)

In Embodiments 1 and 2, descriptions were directed to the case where the irradiated portions irradiated with beams that had passed through the apertures were of a greater width than that of the phosphor lines. In this case, the shape of each light emitting region substantially depends on the shape of each phosphor line. Therefore, in order that the light emitting regions have the wide portions in the vicinities of the shadows of the bridges, it is required that the wide portions be formed on the phosphor lines themselves as described in Embodiments 1 and 2.

However, the present invention also can be applied to the case where the irradiated portions are of a smaller width than that of the phosphor lines. In this case, the shape of each light emitting region substantially depends on the shape of each irradiated portion, not on the shape of each phosphor line. Therefore, in order for the light emitting regions to have the wide portions in the vicinities of the shadows of the bridges, it is not required that the wide portions be formed on the phosphor lines. Instead, it is only required that the apertures of the color selecting electrode be formed in a predetermined shape so that irradiated portions of a desired shape are formed. This will be detailed in the following.

Figure 7:
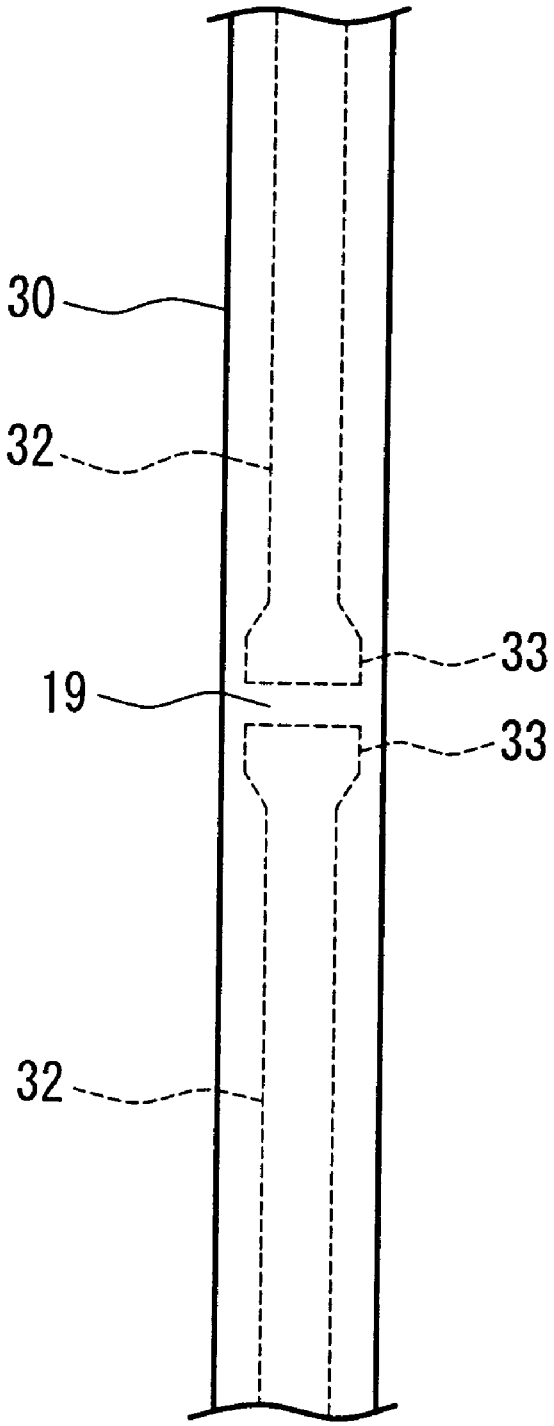
FIG. 7 is a schematic diagram showing a phosphor line and irradiated portions irradiated with electron beams on a phosphor screen of a color picture tube according to Embodiment 3 of the present invention.
Figure 8:
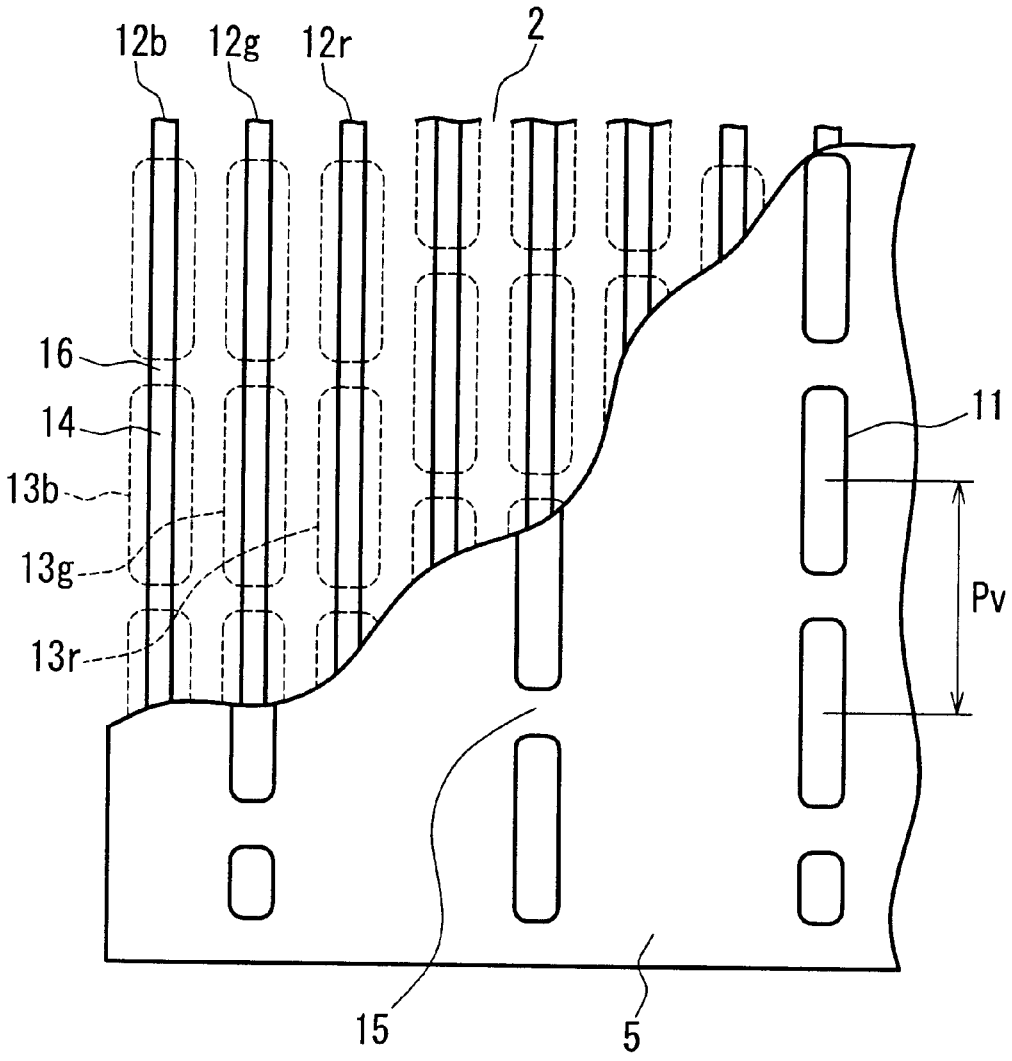
FIG. 8 PRIOR ART
FIG. 8 is a schematic diagram showing a color selecting electrode and a phosphor screen of a conventional color picture tube.

FIG. 7 is a schematic diagram showing a phosphor line formed on a phosphor screen of a color picture tube according to this embodiment and light emitting regions on the phosphor line. In the figure, reference numeral 30 denotes a phosphor line that is formed so as to have a given width in this embodiment. Further, reference character 32 denotes irradiated portions irradiated with beams that have passed through apertures of a color selecting electrode, and reference numeral 19 denotes a shadow (a non-light emitting portion) formed by a bridge provided between the adjacent apertures. In practice, on a phosphor screen of a color picture tube, the phosphor line 30 and the irradiated portions 32 described above are formed in a manner repeated in a lateral direction of a plane on which the figure is drawn so that a multitude of them are formed.

In this embodiment, the phosphor line 30 is of a greater width than that of the irradiated portions 32. In this case, preferably, the apertures of the color selecting electrode are of substantially I-shape (see FIG. 5) with protrusions protruding in a horizontal direction provided on both end portions in a vertical direction. When the irradiated portions 32 are formed on the phosphor screen by beams that have passed through the apertures described above, the irradiated portions 32 are of substantially I-shape as shown in FIG. 7. The irradiated portions 32 emit light, so that the light emitting regions (namely, the irradiated portions 32) have wide portions 33 of a greater width than a basic width of the light emitting regions in the vicinity of the shadow 19 of the bridge.

FIG. 7 showed the case where the color selecting electrode had the apertures of substantially I-shape shown in FIG. 5. However, the apertures of the color selecting electrode may be of substantially T-shape shown in FIG. 6 with a protrusion provided only on one end portion in a vertical direction. In this case, with respect to each of the shadows 19, a wide portion is formed close to only one side in the vertical direction of the shadow 19.

As described above, forming a protrusion on an end portion of an aperture allows an area of a light emitting surface to increase in the vicinity of a shadow of a bridge. Accordingly, a decrease in the luminance of a phosphor screen that is caused by the shadow can be prevented. Further, even when a pitch in a vertical direction of the apertures is set to be large, picture noise that is caused by the shadow is not likely to be perceived considerably. Thus, improvements in the luminance of a displayed image and prevention of a color shift caused by thermal expansion of a color selecting electrode can be realized.

In Embodiments 1 to 3 described above, descriptions were directed to the example in which a tension was applied to the color selecting electrode. However, the present invention also can be applied to a color picture tube having a color selecting electrode formed in the shape of a curved surface.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color picture tube, comprising:

an envelope composed of a face panel having an inner face on which a phosphor screen is formed and a funnel bonded to the rear part of the face panel, the phosphor screen being formed of a plurality of phosphor lines in the form of stripes; and a color selecting electrode opposed to the phosphor screen provided in the envelope, wherein the color selecting electrode has a plurality of apertures and bridges that separate the adjacent apertures from each other in a direction along the phosphor lines, electron beams emitted from an electron gun in the funnel hit the color selecting electrode and pass through the apertures to land at the phosphor screen, and in the vicinities of shadows of the bridges formed as a result of projection by the electron beams, each of light emitting regions in which the phosphor lines emit light by irradiation with the electron beams has a part in which a wide portion of a greater width than a basic width of the light emitting region is provided.

2. The color picture tube according to claim 1, wherein in the vicinities of the shadows, each of the phosphor lines has parts in which a wide portion of a greater width than a basic width of the phosphor lines is provided.

3. The color picture tube according to claim 1, wherein an area S1 of an auxiliary light emitting region, which is obtained by subtracting an area of a basic width light emitting region having a width corresponding to the basic width from an area of the wide portion of the light emitting region, and an area S2 of a basic width non-light emitting region having a width corresponding to the basic width as a part of a non-light emitting portion shaded with the shadow of the bridge, satisfy the relationship: $0.9 \leqq S1/S2 \leqq 1.1$.

4. The color picture tube according to claim 1, wherein a length Lw of the wide portion in a vertical direction and a pitch Pv of the apertures in the vertical direction satisfy the relationship: $0 < Lw/Pv \leqq 0.1$.

5. The color picture tube according to claim 1, wherein each of the apertures of the color selecting electrode has a protrusion protruding in a horizontal direction at least at one end portion in a vertical direction.

6. The color picture tube according to claim 5, wherein a maximum width W1 of the apertures in a horizontal direction in the protrusion and a width W2 of the apertures in the horizontal direction in the midsection satisfy the relationship: $1.0 < W1/W2 \leqq 1.5$.

* * * * *